US006987943B2

(12) United States Patent
Ito

(10) Patent No.: US 6,987,943 B2
(45) Date of Patent: Jan. 17, 2006

(54) CLEANING BLADE, ITS PRODUCTION METHOD, IMAGE FORMING DEVICE, AND IMAGE FORMING METHOD

(75) Inventor: Muneharu Ito, Tokyo (JP)

(73) Assignee: Zeon Corporation, Tokyo (JP)

( * ) Notice: Subject to any disclaimer, the term of this patent is extended or adjusted under 35 U.S.C. 154(b) by 0 days.

(21) Appl. No.: 10/506,684

(22) PCT Filed: Mar. 6, 2003

(86) PCT No.: PCT/JP03/02639

§ 371 (c)(1),
(2), (4) Date: Sep. 20, 2004

(87) PCT Pub. No.: WO03/085459

PCT Pub. Date: Oct. 16, 2003

(65) Prior Publication Data

US 2005/0163544 A1 Jul. 28, 2005

(30) Foreign Application Priority Data

Mar. 22, 2002 (JP) ..... 2002-081356

(51) Int. Cl.
*G03G 21/00* (2006.01)

(52) U.S. Cl. ..... 399/350; 15/256.5; 399/346; 430/125

(58) Field of Classification Search ..... 399/350, 399/343, 71, 98, 99, 346; 430/125; 15/1.51, 15/256.5; 427/430.1, 180, 145
See application file for complete search history.

(56) References Cited

U.S. PATENT DOCUMENTS 5,138,395 A * 8/1992 Lindblad et al. ..... 399/350 X
5,145,724 A * 9/1992 Yanai et al. ..... 427/430.1
5,363,182 A * 11/1994 Kuribayashi et al. ..... 399/350
5,438,400 A * 8/1995 Kuribayashi et al. ..... 399/350
5,450,184 A * 9/1995 Yanai et al. ..... 399/350
5,646,718 A * 7/1997 Suwa et al. ..... 399/350
5,733,702 A * 3/1998 Okado et al. ..... 430/125
6,453,146 B1 * 9/2002 Yamada et al. ..... 399/350
6,649,315 B1 11/2003 Takasaki ..... 430/110.3
2002/0009316 A1 1/2002 Endo et al. ..... 399/349
2002/0031384 A1 * 3/2002 Sato ..... 399/350 X

FOREIGN PATENT DOCUMENTS

| | | |
|---|---|---|
| JP | 04-294380 A * | 10/1992 |
| JP | 5-173359 | 7/1993 |
| JP | 5-188367 | 7/1993 |
| JP | 5-224451 | 9/1993 |
| JP | 6-202534 | 7/1994 |
| JP | 7-266463 | 10/1995 |
| JP | 8-220962 | 8/1996 |
| JP | 8-320641 | 12/1996 |
| JP | 3112362 | 9/2000 |
| WO | WO00/13063 | 3/2000 |

* cited by examiner

*Primary Examiner*—Sophia S. Chen
(74) *Attorney, Agent, or Firm*—Armstrong, Kratz, Quintos, Hanson & Brooks, LLP

(57) ABSTRACT

The invention provides a cleaning blade for removal of an untransferred toner remaining on the surface of an image bearing member. The cleaning blade includes fine particles attached to the surface of at least a portion of the cleaning blade to come into contact with the image bearing member in an amount of attachment of 1 to 10 mg/cm$^2$. A nonionic surfactant is applied to the cleaning blade to attach fine particles to the surfactant-applied portion in an amount of 1 to 10 mg/cm$^2$, followed by drying.

20 Claims, 1 Drawing Sheet

CLEANING BLADE, ITS PRODUCTION METHOD, IMAGE FORMING DEVICE, AND IMAGE FORMING METHOD

TECHNICAL FIELD

The present invention relates generally to a cleaning blade used with image forming device in electro-photographic copiers, printers, electrostatic recorders, etc., and more particularly to a cleaning blade for removal of toner particles that remain untransferred on the surface of an image bearing member such as a photoconductive member. The present invention is also concerned with a process for producing such a cleaning blade, an image forming device equipped with the cleaning blade, and an image forming method using such an image forming device.

BACKGROUND ART

Image forming device with a built-in cleaning blade, so far known in the art, include one having such construction as shown typically in FIG. 1. The image forming device is built up of a photoconductive drum 1, a cleaning unit 2, a charging unit 3, an exposure unit 4, a developing unit 5, a transfer unit 6, and so on. The photoconductive drum 1 is rotated in a direction indicated by an arrow A. The surface of the photoconductive drum 1 is uniformly and consistently charged by the charging unit 3. An image exposure at the exposure unit 4 causes charges on an exposed area to vanish, so that an electrostatic latent image is formed on the photoconductive drum 1.

The electrostatic latent image on the photoconductive drum 1 is developed by a developer fed from the developing unit 5 (which is called an "electrostatic image developing toner" or referred to simply as a "toner") to form a visible (toner) image. The developing unit 5 includes a developing roll 8 and a toner layer thickness control member 9, whereby stored toner is fed to the surface of the photoconductive drum 1. The toner image on the surface of the photoconductive drum 1 is transferred onto a transfer material 7 such as transfer paper via the transfer unit, and then sent to a fixing unit (not shown).

The photoconductive drum 1 is an image bearing member for carrying electrostatic latent images and toner images. A toner image on the photoconductive drum 1 is transferred onto the transfer member 7 via the transfer unit 6; however, a part of the toner often remains untransferred. Such untransferred toner on the photoconductive drum 1 should be removed by the cleaning unit 2 or else images will smudge upon image formation.

In the image forming device depicted in FIG. 1, the cleaning unit 2 includes a cleaning blade 2*a* and a support member 2*b*, which are located around the photoconductive drum 1. The cleaning blade 2*a* is positioned in contact at its end portion with the surface of the photoconductive drum 1. FIG. 2 is illustrative in perspective of the cleaning blade 2*a* and support member 2*b*. The cleaning blade 2*a* is usually bonded to the support member 2*b* by means of an adhesive.

The cleaning blade is a sheet-form member made of an elastic material such as rubber or polyurethane. For efficient removal of untransferred toner on the image bearing member, the cleaning blade is brought into contact at its end portion (edge) with the surface of the image bearing member at a suitable pressure. However, the cleaning blade made of an elastic material has an increased surface friction resistance although having an improved elasticity; if there is no equilibrium between the pressure applied on the image bearing member and frictional force, there will often be the so-called "curling-up" phenomenon, in which the end portion of the cleaning blade is dragged and bent out in the rotational direction of the image bearing member.

To avoid the "curling-up" phenomenon, it has hitherto been proposed to coat the edge of a cleaning blade with a lubricant comprising fine particles having a particle diameter of up to 20 $\mu$m and an improved flowability, and various proposals have been made as to how to coat powdery lubricants for the purpose of enhancing the adhesion thereof to the surface of the cleaning blade.

For instance, Japanese Patent No. 3112362 proposes a method that comprises applying a lubricant-containing solution, wherein a solid lubricant is dispersed in an aqueous solution with an acrylic resin emulsified or suspended therein, to at least a part of the portion of a cleaning blade to come into pressure contact with an image bearing member, followed by drying. In one specific example, the publication shows that a cleaning blade with an edge having a friction coefficient of 0.4 is obtained by applying a lubricant-containing aqueous dispersion with a film thickness of 6 $\mu$m (corresponding to the amount of attached powders of 0.6 mg/cm$^2$) in the vicinity of the edge of a polyurethane cleaning blade, said aqueous dispersion being obtained by dispersion of polytetra-fluoroetheylene powders in an acrylic water emulsion.

Japanese Patent Application Laid-Open No. 7-266463 discloses a method of washing a cleaning blade prepared by bonding an elastic material blade to a support member with an aliphatic hydrocarbon detergent, and coating under pressure fluororesin fine powders on the cleaning blade before the detergent is dried up. With this method, the lubricant could be applied to the end portion of the cleaning blade to decrease frictional force without recourse to solvents such as flon, which are detrimental to environmental health.

Japanese Patent Application Laid-Open No. 8-220962 proposes a method of coating a portion of a cleaning blade to come in pressure contact with an image bearing member with a lubricant dispersion in which a powdery lubricant is dispersed in a fluorine inert liquid having a specific range of surface tension, followed by drying. The publication teaches that the powdery lubricant is preferably configured to a spherical shape. In one specific example, the publication shows that a cleaning blade coated and surface-treated with a powdery lubricant in an amount of 0.75 mg/cm$^2$ is obtainable by dropwise addition and coating of a lubricant dispersion onto the edge portion of a polyurethane blade, followed by drying, said lubricant dispersion being obtained by dispersion of a spherical polymethyl methacrylate having an average particle diameter of 0.5 $\mu$m in a fluorine inert liquid ($C_6F_{14}$).

According to such surface treatment methods that use powdery lubricants, a suitable degree of lubrication could given to the end portion of the cleaning blade to come into contact with an image bearing member, so that friction with the surface of the image bearing member could be reduced thereby avoiding the "curling-up" phenomenon. The cleaning blade surface-treated with the powdery lubricant could keep good cleaning capability over a relatively long period of time, when applied to an image forming device using pulverized toner as a developer. However, it is now found that a cleaning blade surface treated with a conventional powdery lubricant is poor in cleaning capability when applied to an image forming device using spherical toner obtained as by suspension polymerization.

A toner production method is generally divided roughly into a pulverization process and a polymerization process. In the pulverization process, a binder resin and a colorant are hot milled together with other optional additive or additives, and the milled product is pulverized and classified into toner (pulverized toner). The pulverized toner is so made of aspheric particles having a broad particle size distribution that it can be easily removed by a cleaning blade. Problems with the pulverized toner are, however, that classification yields are low because of a considerable amount of fine powders generated at the pulverization step, and that the binder resin, because of being fragile, is finely divided during use, resulting in poor image quality.

By contrast, the polymerized toner is obtainable in the form of spherical colored polymer particles having a sharp particle diameter distribution by dispersing a minute droplet form of a monomer composition containing, for instance, a polymerizable monomer, a colorant and other optional additive or additives in an aqueous dispersion medium for suspension polymerization. Specifically, by control of polymerization conditions, the polymerized toner may be obtained in the form of substantially spherical colored polymer particles that have a sharp particle diameter distribution of 1.0 to 1.4 as expressed in terms of the dv/dn ratio where dv is a volume average particle diameter and dn is a number average particle diameter and a sphericity of 1.0 to 1.3 as expressed in terms of the dl/ds ratio where dl is a particle's major axis and ds is a particle's miner axis. For instance, see Japanese Patent Application Laid-Open No. 5-188637 and WO00/13063.

To meet recent demands for higher-definition images, higher printing speeds and full-color images, for instance, toners are now required to have (1) a smaller volume average particle diameter of up to 10 $\mu$m, preferably up to 9 $\mu$m, and more preferably up to 8 $\mu$m, (2) a sharper particle diameter distribution and a higher degree of sphericity, and (3) a lower fixation temperature without detrimental to shelf stability.

To suit such requirements, polymerized toners having ever smaller particle diameters and ever sharper particle diameter distributions are now under development. To achieve spherical toners having low-temperature fixing ability and shelf stability in a well-balanced state, a capsule toner having the core-shell structure, for instance, is developed by a two-stage polymerization process, by which a colored polymer particle having a low glass transition temperature is surrounded by a polymer layer having a high glass transition temperature.

With the development of toners having a smaller particle diameter, a sharper particle diameter distribution and a higher degree of sphericity simultaneously with improvements in low-temperature fixing ability, shelf stability and durability, however, it is more and more difficult to clean off toner particles remaining unfixed on an image bearing member. Spherical toner particles having a sharp particle diameter distribution are by far much larger than aspheric toner particles having a broad particle diameter distribution in terms of adhesive forces among toner particles and between toner and an image bearing member. In addition, such adhesive forces become strong with a decreasing toner particle diameter. For an image forming method that relies on spherical toner having smaller particle diameters, it is now required to have an improved method for removal of toner particles remaining untransferred on an image bearing member by use of a cleaning unit with a built-in cleaning blade.

With a cleaning method using a cleaning blade made of an elastic material, it is difficult to provide satisfactory removal of spherical, small-diameter toner particles remaining untransferred on an image bearing member. With a conventional cleaning blade wherein a relatively small amount of a powdery lubricant is attached at its end portion having good flowability (e.g., that set forth in Japanese Patent No. 3112362 or Japanese Patent Application Laid-Open No. 8-220962), it is prima facie possible to avoid the "curling-up" phenomenon by virtue of its decreased friction coefficient; however, it is still difficult to achieve satisfactory removal of spherical, small-diameter unfixed toner particles, and even images developed on only a limited number of sheets smudge due to poor cleaning capability.

With a prior method that involves washing a cleaning blade with an aliphatic hydrocarbon detergent and applying under pressure fluororesin fine powders thereon (e.g., that set forth in Japanese Patent Application Laid-Open No. 7-266463), it is inherently difficult to control the amount of the attached fluororesin fine powders because the aliphatic hydrocarbon detergent is likely to volatilize off, resulting in poor reproducibility. Indeed, Japanese Patent Application Laid-Open No. 7-266463 makes no specific reference to the amount of the attached fluororesin fine powders.

Improvements in the cleaning capability of spherical, small-diameter toner may be achieved by increasing the amount of silica or other abrasive particles to be added to the toner; however, this may adversely affect developability and transferability. Improvements in cleaning capability by configuring toner particles to shapes other than a spherical shape are not preferable because not only are such particles difficult to produce but also they render developability and transferability worse.

DISCLOSURE OF THE INVENTION

One object of the invention is to provide a cleaning blade that, even upon used with spherical toner particles, especially spherical, small-diameter toner particles, can kept stable cleaning capability over an extended period of time.

Another object of the invention is to provide a process for producing a cleaning blade with improved reproducibility, an image forming device equipped with such a cleaning blade, and an image forming method that makes use of such an image forming device.

The inventors have made study after study for the purpose of accomplishing the above objects, and have consequently found that if fine particles are applied to the surface of at least a portion of a cleaning blade to come into contact with an image bearing member in an amount of 1 to 10 mg/cm$^2$, not only can the "curling-up" phenomenon be reduced, but the cleaning capability of the cleaning blade also ensures that even upon continued printing of at least 5,000 sheets, preferably at least 10,000 sheets, and more preferably at least 20,000 sheets with a toner comprising spherical, small-diameter particles, no smudge is found on images. Preferably in the invention, the fine particles have an average particle diameter of at least 0.1 $\mu$m, and an aspheric shape as well. Those findings have underlain the invention.

Thus, the present invention provides a cleaning blade for removal of an untransferred toner remaining on a surface of an image bearing member, wherein fine particles are attached to a surface of at least a portion of the cleaning blade to come into contact with the image bearing member in an amount of 1 to 10 mg/cm$^2$.

The present invention also provides a process for producing a surface treated cleaning blade for removal of an untransferred toner remaining on a surface of an image bearing member, which comprises applying a nonionic surfactant to a surface of at least a portion of a cleaning blade to come into contact with the image bearing member, and attaching fine particles to the surfactant-applied portion in an amount of 1 to 10 mg/cm$^2$, followed by drying.

Further, the present invention provides an image forming device equipped with a cleaning blade for removal of an untransferred toner remaining on a surface of an image bearing member, wherein the cleaning blade is a cleaning blade which comprises fine particles attached to a surface of at least a portion thereof to come into contact with the image bearing member in an amount of 1 to 10 mg/cm$^2$.

Furthermore, the present invention provides an image forming method making use of an image forming device equipped with a cleaning blade for removal of an untransferred toner remaining on a surface of an image bearing member, wherein a cleaning blade, which comprises fine particles attached to a surface of at least a portion thereof to come into contact with the image bearing member in an amount of 1 to 10 mg/cm$^2$, is used as the cleaning blade, and a spherical toner is used as a toner.

BEST MODE FOR CARRYING OUT THE INVENTION

1. Cleaning Blade

Generally, the cleaning blade used herein may be made of an elastic material. The elastic material, for instance, includes conjugated diene rubbers such as butadiene rubber, isoprene rubber and acrylonitrile-butadiene rubber; polyurethane, flurorubber, and silicone rubber, although acrylonitrile-butadiene rubber and polyurethane are preferred.

Generally but not exclusively, the cleaning blade should be configured to a sheet shape having a length commensurate with the longitudinal length of an image bearing member (e.g., a photoconductive drum). Preferably but not critically, the cleaning blade has a thickness of usually 1 to 3 mm, and particularly 1.5 to 2.5 mm. The cleaning blade has a JIS A hardness of usually 40 to 90 degrees.

Figure 1:
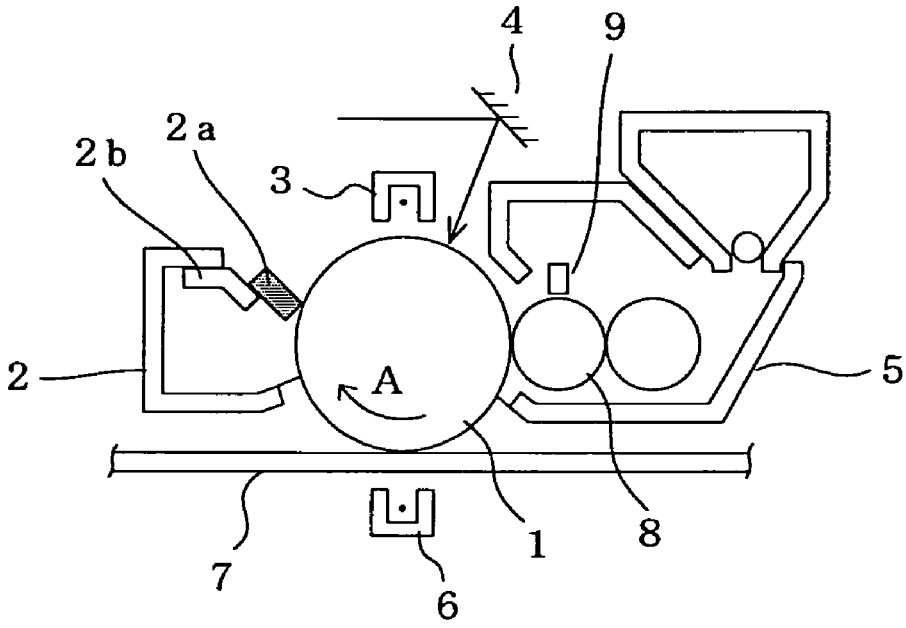
FIG. 1 is illustrative in section of one specific embodiment of an image forming device equipped with a cleaning blade.
Figure 2:
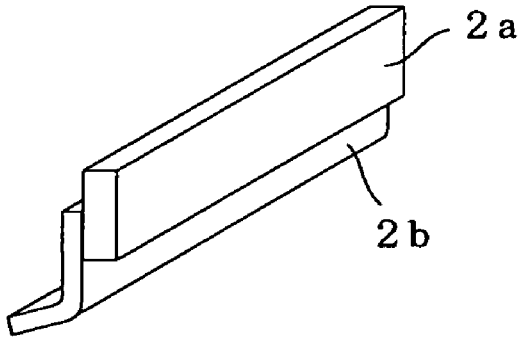
FIG. 2 is illustrative in perspective of one specific embodiment of a cleaning blade.

As shown in FIG. 2, a cleaning blade 2*a* is usually attached to a support member 2*b* as by an adhesive. The support member 2*b* is attached to a cleaning unit body (housing). As shown in FIG. 1, the cleaning blade 2*a* works in contact with the surface of an image bearing member (a photoconductive drum 1), and the angle of contact of the cleaning blade 2*a* (an acute portion) is usually 30 to 80 degrees, and preferably 40 to 70 degrees. The "angle of contact" used herein means an angle of the cleaning blade with respect to a normal at a point where the cleaning blade contacts the photoconductive drum; that is, it means an angle of (the acute portion of) the cleaning blade 2*a* with respect to a normal of connecting a point where the cleaning blade contacts the surface of the photoconductive drum 1 with the central point of the photoconductive drum 1 of a circular shape in section.

2. Fine Particles

The fine particles used herein attached to the cleaning blade, for instance, include organic ones comprising synthetic resins such as polyolefin resin, e.g., polyethylene and polypropylene; fluroresins, e.g., polytetrafluoroethylene and polyvinylidene fluoride; polyester resins, e.g., polyethylene terephthalate; acrylic resins, e.g., polymethyl methacrylate; aromatic vinyl resins, e.g., polystyrene; and copolymer resins, e.g., styrene-n-butyl acrylate copolymer. Those organic fine particles are preferably an aspheric pulverized resin fine particles obtained by pulverization of resin.

Alternatively, a toner could be used as the fine particles. Preferably in this case, the toner is an aspheric pulverized toner that contains a binder resin and a colorant. Moreover, fine particles of such inorganic materials as calcium carbonate, calcium phosphate, silica and molybdenum sulfide could be used as the fine particles.

The fine particles used herein have various aspheric shapes such as amorphous shape, cubic shape (e.g., cubic calcium carbonate), cuboidal shape and polyhedral shape. Aspheric fine particles obtained by pulverization, such as the aforesaid pulverized resin fine particles and pulverized toners, are preferable to this end. The inorganic fine particles, too, are preferably in aspheric shapes such as amorphous or cubic shapes.

Generally, fine particles obtained by pulverization of resins have an amorphous shape, and so it is evident that fine particles of pulverized resins and pulverized toners are in an amorphous shape. Although fine particles being in an aspheric shape may be determined by observation under a microscope, it may also be checked by sphericity defined in terms of the major axis (dl)-to-minor axis (ds) ratio or the dl/ds ratio of a particle; a dl/ds ratio of greater than 1.3 means that the particle has an aspheric shape.

The fine particles used herein have an average particle diameter of preferably at least 0.1 $\mu$m. More favorable results are obtainable at an average particle diameter of more preferably about 0.1 to 20 $\mu$m, even more preferably about 0.3 to 15 $\mu$m, and most preferably about 0.5 to 10 $\mu$m. The average particle diameter of fine particles referred to herein was determined by measurement with a laser particle size distribution meter (Microtrack FRA made by Nikkiso Co., Ltd.) of a dispersion in which fine particles were dispersed by a neutral detergent in water.

3. Surface-Treated Cleaning Blade Production Process

The cleaning blade for removal of an untransferred toner remaining on the surface of the image bearing member according to the invention may be produced by a process in which the fine particles are attached to the surface of at least a portion of the cleaning blade to come into contact with the image bearing member in an amount of attachment of 1 to 10 mg/cm$^2$.

Referring specifically to the attachment of the fine particles, the fine particles are dispersed in, for instance, a variety of organic solvents or surfactants, acrylic emulsions, acrylic dispersions or the like to thereby prepare a dispersion, which is in turn applied to a given portion of the image bearing member, followed by drying. In the invention, it is particularly preferred that a nonionic surfactant is applied to the surface of at least a portion, to come in contact with the image bearing member, of the cleaning blade for removal of a toner untransferred on the surface of the image bearing member, and the fine particles are attached to the thus surfactant-applied surface in an amount of 1 to 10 mg/cm$^2$, followed by drying.

Use of volatile organic solvents renders it difficult to apply fine particles with good reproducibility in a given constant amount for their attachment. By use of a less volatile nonionic surfactant, however, it is possible to apply fine particles with good reproducibility in a given constant amount for their attachment. In addition, it is possible to reduce adverse influences on the chargeability, etc. of toner. Preferable nonionic surfactants may include a commercially available neutral detergent.

Preferably, the cleaning blade surface treated with fine particles is produced by applying a nonionic surfactant to the surface of at least a portion of a cleaning blade to come into contact with an image bearing member, and then bringing fine particles into contact with the nonionic surfactant while it stays wetted to attach the fine particles to the surfactant-applied surface substantially uniformly, followed by drying at a temperature of usually 30 to 90° C., and preferably 35 to 60° C. Usually, drying is carried out under a hot-air atmosphere, e.g., in a drier.

It is not always necessary to attach the fine particles all over the surface of the cleaning blade; if the fine particles are attached on and around the end portion of the cleaning blade to come into contact with the image bearing member, then the desired object is usually achievable. The amount of attachment of the fine particles on the surface of the cleaning blade is 1 to 10 mg/cm$^2$, and preferably 1 to 9 mg/cm$^2$. Often, favorable results are obtainable at 1.2 to 9 mg/cm$^2$.

4. Image-Formation Device

The invention provides an image forming device equipped with a cleaning blade for removal of a toner untransferred on the surface of an image bearing member. This cleaning blade comprises the fine particles which is attached to the surface of at least a portion thereof to come into contact with the image bearing member in an amount of 1 to 10 mg/cm$^2$.

Insofar as the image forming device of the invention equipped with such a cleaning blade, no particular limitation is imposed on other construction thereof. For instance, FIG. 1 is illustrative in section of one exemplary embodiment of an image forming device using a non-magnetic one-component developer, and the present invention encompasses an image forming device having such construction as well.

Further, the present invention embraces a color image forming device comprising three developing units for receiving color toners colored in cyan, yellow and magenta, respectively, so that color images can be formed. Furthermore, the present invention includes a color image forming device comprising three such developing units plus a fourth developing unit for receiving black toner.

More specifically, the color image forming device according to the invention works in (1) a multi-development mode wherein multicolor toner images are developed on a photoconductive drum (an image bearing member) and then transferred onto a transfer material by one operation, and (2) a multi-transfer mode wherein a process of developing only a single color image on a photoconductive drum and then transferring it onto a transfer material is repeated as many times as colors of color toners. The multi-transfer mode is broken down into (i) a transfer drum mode wherein a transfer material is wound up around a transfer drum for transfer for each color, (ii) an intermediate transfer mode wherein primary transfer is carried out on an intermediate transfer member for each color to form a multicolor image on an intermediate transfer material, and the multicolor image is thereafter subjected to secondary transfer onto a transfer material by one operation, and (iii) a tandem mode wherein a plurality of image-formation units each including a photoconductive drum and a developing unit are located in a tandem fashion wherein a transfer material is sucked and delivered on a transfer delivery belt for successive transfer of colors on the transfer material. A tandem mode of image forming device is preferred for high-speed image formation.

In a preferred tandem mode of color image-formation system, for instance, as many image-formation sections as the colors used are successively located, in each of which a set of laser irradiator, photoconductive drum, developer and cleaner is provided. Usually in each image-formation section, toners are located in order of yellow, magenta, cyan and black along a delivery belt. A transfer material is delivered on the delivery belt so that images of the respective colors formed on the respective image-formation sections are successively superposed one another for transfer and fixation. The transfer material is generally delivered by means of a delivery belt; however, it may be delivered while sucked on a transfer drum.

5. Image Forming Method

With the image forming device equipped with the aforesaid cleaning blade, images may be formed. The present invention provides an image forming method making use of an image forming device equipped with a cleaning blade for removal of an untransferred toner remaining on the surface of an image bearing member, wherein a cleaning blade, which comprises the fine particles attached to the surface of at least a portion of the cleaning blade to come into contact with the image bearing member in an amount of 1 to 10 mg/cm$^2$, is used as the cleaning blade, and a spherical toner is used for a toner.

In one exemplary embodiment of the image forming method according to the invention, such an image forming device as shown in FIG. 1 is used. First, the surface of a photoconductive drum 1 is uniformly and consistently charged by a charging unit 3. The surface of the photoconductive drum 1 is exposed to light via an exposure unit 4 to form an electrostatic latent image. A toner is supplied to a developing unit 5 by way of a developing roll 8. The thickness of the toner supplied is controlled by a toner layer thickness control member 9. The electrostatic latent image on the photoconductive drum 1 is developed into a visible (toner) image. The toner image on the photoconductive drum 1 is transferred onto a transfer material 7 by means of a transfer unit 6. The toner image transferred onto the transfer material 7 is fed to a fixing step where it is fixed on the transfer material 7 with the application of heat and pressure, etc.

To form color images, a variety of image-formation systems relying upon tandem or other modes may be used. Preferably in this case, spherical toner colored in a color tone selected from cyan, yellow, magenta and black are used as the spherical toner.

6. Toner for Development of Electrostatic Charge Image

The cleaning blade of the invention is usable with an image forming device wherein an ordinary pulverized or polymerized toner is employed as a toner for development of electrostatic charge images, thereby ensuring improved cleaning capability. As a matter of course, there is no "curling-up" phenomenon of the cleaning blade when the image forming device is in operation.

The cleaning blade of the invention and the image forming device that incorporates said cleaning blade ensure that improved cleaning capability is achievable even with spherical toners having a sharp particle diameter distribution, for instance, polymerized toners. In addition, such cleaning capability does not drop even with spherical, small-diameter toners. Now, such spherical toners are explained.

A spherical toner is generally obtainable by emulsion, aggregation, dispersion, suspension or like other polymerization processes, with which toner particles of micron order may be directly obtained with a relatively narrow particle diameter distribution. The spherical toner may be a capsule toner having a core-shell structure wherein the surface of a colored polymer particles is provided with a polymer coating layer. In view of a developer's properties in particular, it is desired that a polymerized toner obtained by suspension polymerization be used as the spherical toner. Preferably, the capsule toner is obtained by a specific process wherein a colored polymer particles that provides a core is formed by suspension polymerization, and a polymerizable monomer that provides a shell is polymerized in the presence of the colored polymer particles to form a core-shell structured polymer particle having the colored polymer particles coated with a polymer layer.

The volume average particle diameter (dv) of a spherical toner (inclusive of a capsule toner) is usually about 2 to 15 μm, although it may be selected from the range of 2 to 30 μm. To obtain images of high quality, it is preferable to use a spherical, small-diameter toner. The spherical, small-diameter toner has a volume average particle diameter of preferably 2 to 10 μm, more preferably 4 to 9 μm, and even more preferably 5 to 8 μm. The particle diameter distribution (dv/dp) of a spherical toner represented by a dv/dp ratio where dv is a volume average particle diameter and dp is a number average particle diameter is usually 1.6 or lower; however, a spherical toner having a sharper particle diameter distribution has a dv/dp ratio of 1.3 or lower. A spherical toner has a sphericity of usually 1 to 1.3, and preferably 1 to 1.2, as expressed in terms of a dl/ds ratio where dl is a major axis and ds is a miner axis.

In the capsule toner having the core-shell structure, the shell has a average thickness of usually 0.001 to 1.0 μm, preferably 0.003 to 0.5 μm, and more preferably 0.005 to 0.2 μm. Too thick a shell renders fixing ability likely to become worse, whereas too thin a shell is less effective at improvements in shelf stability.

A polymerized toner by suspension polymerization may be obtained by suspension polymerization in a dispersion stabilizer-containing aqueous dispersion medium of a polymerizable monomer composition that at least contains a polymerizable monomer and a colorant. The polymerizable monomer is polymerized into a polymer that becomes a binder resin. Capsule toners having the core-shell structure may be produced as by spray drying processes, interface reaction processes, in situ polymerization processes and phase separation processes, among which the in situ polymerization processes and phase separation processes are particularly preferred because of high production efficiencies.

Referring specifically to the polymerization processes, a polymerizable monomer composition that at least contains a polymerizable monomer, a colorant and a softener is suspension polymerized in a dispersion stabilizer-containing aqueous dispersion medium to obtain a colored polymer particle acting as a core, and a shell-forming polymerizable monomer is suspension polymerized in the presence of said core, so that a capsule toner is obtainable. The shell-forming monomer is polymerized into a polymer layer that behaves as a coating layer.

If necessary, the polymerizable monomer composition may contain various additives such as crosslinkable monomers, macromonomers, molecular weight modifiers, charge control agents, general-purpose parting agents, lubricant and dispersion aids.

Preferable examples of the polymerizable monomer are monovinylic monomers exemplified by styrene type monomers such as styrene, vinyltoluene and α-metylstyrene; acrylic acid and methacrylic acid; derivatives of acrylic or methacrylic acid such as methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide and methacrylamide; ethylenic unsaturated monoolefins such as ethylene, propylene and butylenes; vinyl halides such as vinyl chloride, vinylidene chloride and vinyl fluoride; vinyl esters such as vinyl acetate and vinyl propionate; vinyl ethers such as vinyl methyl ether and vinyl ethyl ether; vinyl ketones such as vinyl methyl ketone and methyl isopropenyl ketone; and nitrogenous vinyl compounds such as 2-vinylpyridine, 4-vinylpridine and N-vinylpyrrolidone.

The monovinylic monomers may be used alone or in combination of two or more. A preferable monovinylic monomer is a combined styrene monomer and (meth)acrylic acid derivative.

Combined use of the polymerizable monomer with a crosslinkable monomer and/or a crosslinkable polymer is effective at improvements in hot offset properties. The crosslinkable monomer is a monomer that has two or more polymerizable carbon-carbon unsaturated double bonds, and the crosslinkable polymer is a polymer that has two or more polymerizable carbon-carbon unsaturated double bonds. Combined use of the polymerizable monomer with a macromonomer enables shelf stability, prevention of offset, low-temperature fixing ability and so on to be placed in a well-balanced state.

For the colorant, various pigments and dyes such as carbon black and titanium white used so far in the toner field may be used. For the black colorant, use may be made of dyes and pigments based on carbon black and nigrosine; and magnetic particles such as those of cobalt, nickel, triiron tetraoxide, manganese iron oxide, zinc iron oxide and nickel iron oxide. Use of carbon black having a primary particle diameter of 20 to 40 nm is preferred because good image quality is achievable with improvements in the environmental health of toners. For the colorant for color toners, for instance, yellow, magenta and cyan colorants may be used.

To enhance the chargeability of the toner, it is preferable to have a positively or negatively chargeable charge control agent contained in the monomer composition. For the charge control agent, for instance, metal complexes of organic compounds having a carboxyl group or a nitrogenous group, metallic dyes, nigrosines and charge control resins may be used. The toner may also contain various parting agents for the purpose of prevention of offset, improvements in releasability upon fixation by a hot roll, etc.

A radical polymerization initiator is preferably used for the polymerization initiator. More preferable to this end is an oil-soluble radical initiator that is soluble in the polymerizable monomer, and that could be used in combination with a water-soluble initiator, if required.

The dispersion stabilizer used herein, for instance, includes sulfates such as barium sulfate and calcium sulfate; carbonates such as barium carbonate, calcium carbonate and magnesium carbonate; phosphates such as calcium phosphate; metal oxides such as aluminum oxide and titanium oxide; metal hydroxides such as aluminum hydroxide, magnesium hydroxide and ferric hydroxide; water-soluble polymers such as polyvinyl alcohol, methyl-cellulose and gelatin; and surfactants such as anionic surfactants, nonionic surfactants and amphoteric surfactants, among which metal compounds such as sulfates, carbonates, metal oxides and metal hydroxides are preferable and colloids of hardly water-soluble metal compounds are even more preferred. In particular, the colloids of hardly water-soluble metal hydroxides are best suited because the particle diameter distribution of toner particles can be made narrow with improvements in the definition of images.

Although how to prepare the colloids of hardly water-soluble metal compound is not critical, they should preferably be colloids of hardly water-soluble metal hydroxides, which are obtained by adjustment to 7 or higher of the pH of an aqueous solution of water-soluble polyvalent metal compounds, and especially colloids of hardly water-soluble metal hydroxides, which are formed by reactions in an aqueous phase of water-soluble polyvalent metal compounds and alkali metal hydroxides. A preferable colloid of hardly water-soluble metal compound has a number base particle diameter distribution D50 (a 50% cumulative value of number base particle diameter distribution) of 0.5 $\mu$m or less and D90 (a 90% cumulative value of number base particle diameter distribution) of 1 $\mu$m or less. Too large colloid particle diameters cause the stability of polymerization and the shelf stability of toner to become worse.

The polymerizable monomer composition that is an oily mixed solution is prepared by dispersion in a bead mill or the like of a mixture of the polymerizable monomer and colorant with other additives (e.g., a charge control agent and a parting agent). Then, the polymerizable monomer composition is introduced in a dispersion stabilizer-containing aqueous dispersion medium, which is in turn agitated by a stirrer. After polymerizable monomer composition droplets have a consistent diameter, the polymerization initiator is passed into the polymerizable monomer composition droplets.

Then, a mixer having high shear force is used to reduce the polymerizable monomer composition droplets down to finer droplets having a particle diameter substantially comparable to the particle diameter of the polymerized toner to be formed, whereupon polymerization is carried out at a temperature of usually 5 to 120° C., and preferably 35 to 95° C. Preferably, after an aqueous dispersion medium containing such polymerizable monomer composition droplets is prepared in a separate vessel or mixer, it is introduced into a reactor in which the monomer is polymerized. In this way, the colored polymer particles are formed. The formed colored polymer particles are collected for use as a polymerized toner.

A capsule toner having core-shell structure is preferably prepared by an in situ polymerization process. It is noted, however, that formation of polymer particles having the core-shell structure is facilitated by addition of a water-soluble polymerization initiator to a polymerization reaction system upon addition of the shell-forming polymerizable monomer thereto.

For instance, the core-forming polymerizable monomer used herein may be the same as those exemplified in connection with the aforesaid polymerizable monomer. In particular, it is preferable to use a polymerizable monomer capable of forming a polymer having a glass transition temperature of usually 60° C. or lower, and preferably 40 to 60° C. When the glass transition temperature of the core-forming polymer component is too high, there is a fixing temperature rise, and when it is too low, there is a shelf stability decrease. For adjustment of glass transition temperature, combinations of two or more monomers are often used for the core-forming polymerization monomer. The shell-forming polymerizable monomer is added to the obtained core particle for re-polymerization, so that the shell layer of the capsule toner can be obtained.

Preferably, the shell-forming polymerizable monomer should be capable of forming a polymer that has a glass transition temperature higher than that of the polymer that provides the core particle. For the shell-forming polymerizable monomer, polymerizable monomers capable of forming a polymer having a glass transition temperature of usually 80° C. or higher, such as styrene and methyl methacrylate, should preferably be used alone or in combination of two or more.

If the glass transition temperature of the polymer comprising the shell-forming polymerizable monomer is at least set in such a way as to be higher than that of the polymer comprising the core particle-forming polymerizable monomer, it is then possible to lower the fixing temperature of the ensuing polymerized toner and enhance the shelf stability thereof. In favor of the shelf stability of the polymerized toner, the glass transition temperature of the polymer obtained from the shell-forming polymerizable monomer should be in the range of usually higher than 50° C. to not higher than 120° C., preferably higher than 60° C. to not higher than 110° C., and even more preferably higher than 80° C. to not higher than 105° C.

A difference in glass transition temperature between the polymer comprising the core-forming polymerizable monomer and the polymer comprising the shell-forming polymerizable monomer is usually at least 10° C., preferably at least 20° C., and even more preferably at least 30° C.

The ratio of the core-forming polymerizable monomer to the shell-forming polymerizable monomer used is usually in the range of 80:20 to 99.9:0.1 by weight. Too little shell-forming polymerizable monomer is less effective at improvements in shelf stability, whereas too much is less effective at a lowering of fixing temperature.

When the polymerized toner is used as a non-magnetic one-component developer, external additives may be added thereto, if required. The external additives include inorganic particles or organic resin particles acting as fluidizing agent, abrasives and so on.

For the inorganic particles, for instance, silicon dioxide (silica), calcium carbonate, aluminum oxide (alumina), titanium oxide, zinc oxide, tin oxide, barium titanate and strontium titanate may be used. The organic resin particles, for instance, include methacrylic ester polymer particles, acrylic ester polymer particles, styrene-methacrylic ester copolymer particles, styrene-acrylic ester copolymer particles, and core-shell structured particles comprising a styrene polymer core and a methacrylic ester copolymer shell.

EXAMPLES

More specifically but not exclusively, the present invention is now explained with reference to inventive, and comparative examples. Unless otherwise stated, part or parts and % are given on a weight basis. Physical properties were measured as follows.

(1) Particle Diameter and Particle Diameter Distribution

A volume average particle diameter (dv) of particles, and a particle diameter distribution of particles, that is, a dv/dp ratio where dv is a volume average particle diameter and dp is a number average particle diameter, was measured by Multisizer (Beckman Coulter Co., Ltd.) under conditions involving an aperture diameter of 100 mm, a medium Isotone II and 100,000 particles for each measurement.

(2) Sphericity

For measurement of the sphericity of toner or the like, a photograph was taken of particles by a scanning electron microscope. Then, the photograph was loaded in an image processor Nexus 9000 Model to find a value (rl/rs) where rl and rs are the major axis and miner axis of each particle, respectively. For each measurement, 100 particles were used.

(3) Volume Resistivity

The volume resistivity of toner was measured under conditions involving a temperature of 30° C. and a frequency of 1 kHz, using a dielectric loss meter (TRS-10 Model made by Andoh Electric Corporation).

(4) Cleaning Capability

A cleaning blade was detached from a commercially available printer using a pulverized toner for attachment of the fine particles to its portion to contact a photoconductive member, and then again attached in place. Using this printer, continuous printing was carried out in a halftone printing pattern with a spherical, small-diameter polymerized toner having the core-shell structure to find how many sheets could be printed before smudges were found due to poor cleaning capability. The printer was stopped at the 20,000$^{th}$ sheet when printing could be carried out with no smudge due to poor cleaning capability or else how many sheets could be printed before smudges were found on images was counted.

Example 1

1. Pulverization of Colorant

Twenty-four (24) parts of toluene and 6 parts of methanol were dispersed in 100 parts of a charge control resin consisting of 82% of styrene, 11% of n-butyl acrylate and 7% of dimethylaminobenzyl chloride of methacrylic acid (and having a weight-average molecular weight of 12,000 and a glass transition temperature of 67° C.), and the dispersion was milled by means of a two-roll arrangement while cooled off, i.e., with no application of heat. After the charge control resin was wound up around the two-roll arrangement, 100 parts of magenta pigment (C.I. Pigment Red 122 made by Client Co., Ltd.) were slowly added thereto for milling and dispersion. A roll nip was gradually widened from an initial 1 mm up to 3 mm. One hour was taken for milling. An organic solvent was added in proportions depending on to what degree the charge control resin was milled.

After milling, the charge control resin with the pigment dispersed therein was sampled out, and a sample was dissolved in toluene into a 5% solution of toluene. Using a doctor blade having a blade gap of 30 μm, the toluene solution was cast on a glass sheet and dried into a sheet. As a result of observation of that sheet under an optical microscope (of 400×) for the purpose of observing what state the pigment was dispersed in, pigment particles greater than 0.1 μm were not found in a field of view of 100 μm×100 μm.

2. Preparation of Colloid Solution

An aqueous solution of 6.9 parts of sodium hydroxide dissolved in 50 parts of ion-exchange water was slowly added dropwise to an aqueous solution of 9.8 parts of magnesium chloride (a water-soluble polyvalent metal salt) dissolved in 250 parts of ion-exchange water to prepare a dispersion of magnesium hydroxide colloid (colloid of hardly water-soluble metal hydroxide). The thus formed colloid had a number average particle diameter D50 (a 50% cumulative value of number particle diameter distribution) of 0.36 μm and D90 (a 90% cumulative value of number particle diameter distribution) of 0.68 μm. The particle diameter distribution was measured on a particle diameter distribution meter (SALD 2000A Model made by Shimadzu Corporation) under conditions involving a refractive index of 1.55–0.20 i, an ultrasonic irradiation time of 5 minutes and a 10% NaOH solution used as a dispersion medium upon measurement of droplets.

3. Core-Forming Monomer Composition

A total of 100 parts of a core-forming polymerizable monomer consisting of 80.5 parts of styrene and 19.5 parts of n-butyl acrylate, 12 parts of a charge control resin with the aforesaid colorant Pigment Red 122 dispersed therein, 0.7 part of divinylbenzene, 1 part of triisobutylmercaptan, 1 part of tetraethylthiuram disulfide and 10 parts of pentaerythritol hexamyristate were stirred and mixed together for uniform dispersion, thereby obtaining a core-forming monomer composition.

4. Aqueous Dispersion of Shell-Forming Monomer

Two (2) parts of methyl methacrylate (having a calculated Tg of 105° C.) and 100 parts of water were finely dispersed by means of an ultrasonic emulsifier to obtain an aqueous dispersion of a shell-forming monomer. Droplets of the shell-forming monomer have a diameter of 1.6 μm in terms of D90, as measured by SALD 2000A Model made by Shimadzu Corporation.

5. Preparation of Capsule Toner

The aforesaid core-forming monomer composition was introduced in the aforesaid magnesium hydroxide colloid dispersion and stirred until droplets were stabilized. After 6 parts of a polymerization initiator t-butyl peroxy-2-ethylhexanoate (Perbutyl O made by Nippon Fats & Oils Co., Ltd.) were added thereto, a 30-minute high shear stirring was carried out at 15,000 rpm using Ebara Milder to make droplets of the monomer composition. An aqueous dispersion of the droplets of the monomer composition was placed in a 10-L reactor having a stirring blade, in which a polymerization reaction was initiated at 90° C., and upon the rate of conversion by polymerization reaching substantially 100%, sampling was carried out to measure the particle diameter of polymer (core) particles. Consequently, the core particles were found to have an average particle diameter of 7.4 μm.

An aqueous dispersion of the aforesaid shell-forming polymerizable monomer, and 0.2 part of an water-soluble initiator (VA-086 (2,2'-azobis[2-methyl-N-(2 -hydroxyethyl)-propionamide]) made by Wakoh Junyaku Co., Ltd.) dissolved in 65 parts of distilled water were placed in a reactor. After an 8-hour continued polymerization, the reaction was stopped to obtain a pH 9.5 aqueous dispersion of polymer particles.

The aqueous dispersion of polymer particles obtained as mentioned above was washed with sulfuric acid at 25° C. for 10 minutes while the pH of a system was kept at 5 or lower, and water was filtered off. Then, 500 parts of fresh ion-exchange water were added to the system for re-slurring and water washing. Thereafter, a process of dehydration and water washing was repeated several times and the solid content was separated by filtration. Drying was carried out at 45° C. for two days in a drier to obtain polymer particles.

The dried polymer particles, taken out of the drier, were found by measurement to have a volume average particle diameter (dv) of 7.4 μm and a dv/dp ratio of 1.23, where dv is a volume average particle diameter and dp is a number average particle diameter. The polymer particles were also found to have a sphericity rl/rs of 1.1 and a toluene-insoluble content of 58%.

6. Preparation of Developer

Zero point six (0.6) part of colloidal silica subjected to hydrophobic treatment (RX-300 made by Nippon Aerosil Co., Ltd.) and 0.3 part of calcium carbonate having an average particle diameter of 0.3 μm (CUBE-03BHS made by Maruo Calcium Co., Ltd.) were added to 100 parts of the polymer particles obtained as mentioned above, and mixed therewith using a Henschel mixer to prepare a nonmagnetic one-component developer. The thus obtained nonmagnetic one-component developer was found by measurement to have a volume resistivity of 12.2 (log Ω*cm).

7. Surface Treatment of Cleaning Blade

Polyester resin (Lunapier 1416 made by Arakawa Chemical Co., Ltd. with a Tg of 62° C., an acid value of 8, a hydroxyl value of 14, and a molecular weight distribution Mw/Mn of 8600/3500=2.5) was milled at a roll temperature of 110° C., then cooled, and finally finely pulverized. The pulverized polyester resin was classified to obtain amorphous resin particles having an average particle diameter of 3 μm. A photoconductive member-dedicated cleaning blade (made of polyurethane with a JIS A hardness of 65, a cleaning blade angle of 65° with respect to photoconductive member and a thickness of 2 mm) was detached from within a commercially available color printer of the type that worked in a non-magnetic one-component developer mode for development with a pulverized toner. After the surface of the cleaning blade was washed with isopropyl alcohol and dried, a neutral detergent (Drywell made by Fuji Photo Film Co., Ltd.) was thinly applied to a 2-mm, smooth end portion of the cleaning blade and a side portion thereof to contact a photoconductive member at a width of 5 mm.

The aforesaid amorphous resin fine particles were applied to the surface of the cleaning blade that was being wetted with the neutral detergent. When the thickness of the resin fine particles was irregular, the cleaning blade was tapped to knock off thicker portions for leveling. Thereafter, the cleaning blade was dried at 40° C. for one day in a drier to fix the resin fine particles onto the surface of the cleaning blade.

After drying, the weight (a) of the cleaning blade was measured. Using a cutter knife wiped with methanol, resin fine particles were stripped of the (2-mm wide) smooth end portion of the cleaning blade over a length of 5 cm to measure the weight (b) of the cleaning blade. The amount of the attached resin fine particles per unit area was calculated to be 4.7 mg/cm$^2$ from the weight difference (a–b) of the cleaning blade.

8. Estimation of Cleaning Capability

The thus obtained cleaning blade was fed back in a cleaning unit. A pulverized toner was removed out of a developing unit for replacement by a polymerization capsule toner produced as mentioned above. Continued printing with the capsule toner was estimated. The results are shown in Table 1. As can be seen from the estimation of cleaning capability, any smudges were not obtained at all even after continued printing of 20,000 sheets. Referring here to estimation of image quality as well, much more satisfactory images having good color tones and high image densities yet with no fogging could be obtained even after printing of 20,000 sheets.

Example 2

In place of the pulverized polyester resin, a styrene-acrylate resin (Lunapier ST-1 made by Arakawa Chemical Co., Ltd. with a Tg of 65° C., an acid value of 13, and a molecular weight distribution Mw/Mn of 110000/8000=13.7) was used for the fine particles to be attached onto the cleaning blade. This styrene-acrylate resin was pulverized and classified into amorphous, pulverized resin fine particles (having an average particle diameter of 5 μm), which were then attached to the cleaning blade in an amount of 1.2 mg/cm$^2$. A cleaning blade with fine particles attached to it was prepared and used for estimation of continued printing in otherwise the same manner as in Example 1. The results are shown in Table 1.

Example 3

In place of the pulverized polyester resin fine particles, cubic calcium carbonate (CUBE-50BHS made by Maruo Calcium Co., Ltd. with an average particle diameter of 5 μm) was used for the fine particles to be attached onto a cleaning blade. The fine particles were attached to the cleaning blade in an amount of 8.7 mg/cm$^2$. A cleaning blade with fine particles attached to it was prepared and used for estimation of continued printing in otherwise the same manner as in Example 1. The results are shown in Table 1.

Example 4

In place of the pulverized polyester resin, an amorphous pulverized toner (having an average particle diameter of 9 μm), which was obtained by roll hot milling at 110° C., pulverization and classification of 100 parts of a styrene-acrylate resin (Lunapier ST-1 made by Arakawa Chemical Co., Ltd.) with 6 parts of carbon black (#25 made by Mitsubishi Chemical Co., Ltd.) and 2 parts of a charge control agent (Sprion Black TRH made by Hodogaya Chemical Co., Ltd.), was used for the fine particles to be attached onto a cleaning blade. The fine particles were attached to the cleaning blade in an amount of 2.8 mg/cm$^2$. A cleaning blade with fine particles attached to it was prepared and used for estimation of continued printing in otherwise the same manner as in Example 1. The results are shown in Table 1.

Comparative Example 1

The amount per unit area of the pulverized polyester resin fine particles attached onto the cleaning blade was changed from 4.7 mg/cm$^2$ to 0.8 mg/cm$^2$. A cleaning blade with fine particles attached to it was prepared and used for estimation of continued printing in otherwise the same manner as in Example 1. The results are shown in Table 1.

Comparative Example 2

The amount per unit area of the pulverized polyester resin fine particles attached onto the cleaning blade was changed from 4.7 mg/cm$^2$ to 11.2 mg/cm$^2$. A cleaning blade with fine particles attached to it was prepared and used for estimation of continued printing in otherwise the same manner as in Example 1. The results are shown in Table 1.

Comparative Example 3

In place of the pulverized polyester resin, amorphous silica (RX-50 made by Nippon Aerosil Co., Ltd.) having an average particle diameter of 0.04 μm was used for the fine particles to be attached onto the cleaning blade, and the amount thereof per unit area was changed from 4.7 mg/cm$^2$ to 0.3 mg/cm$^2$. A cleaning blade with fine particles attached to it was prepared and used for estimation of continued printing in otherwise the same manner as in Example 1. The results are shown in Table 1.

Comparative Example 4

In place of the pulverized polyester resin, spherical polymethyl methacrylate resin particles (MP1000 made by Soken Chemical Co., Ltd.) having an average particle diameter of 0.4 μm was used for the fine particles to be attached onto the cleaning blade, and the amount of thereof per unit area was changed from 4.7 mg/cm to 0.8 mg/cm. A cleaning blade with fine particles attached to it was prepared and used for estimation of continued printing in otherwise the same manner as in Example 1. The results are shown in Table 1.

TABLE 1

| | Fine Particles | | | | |
|---|---|---|---|---|---|
| | Type | Shape | Particle diameter (μm) | Amount of fine particles attached to blade (mg/cm$^2$) | Cleaning Capability (in term of the number of sheets) |
| Ex.1 | Polyester Resin | Amorphous | 3 | 4.7 | No problem up to 20,000 |
| Ex.2 | Styrene-Acrylate Resin | Amorphous | 5 | 1.2 | No problem up to 20,000 |
| Ex.3 | Calcium Carbonate | Cubic | 5 | 8.7 | No problem up to 20,000 |
| Ex.4 | Pulverized Toner | Amorphous | 9 | 2.8 | No problem up to 20,000 |
| Comp.Ex.1 | Polyester Resin | Amorphous | 3 | 0.8 | Cleaning capability became poor at 4,000. |
| Comp.Ex.2 | Polyester Resin | Amorphous | 3 | 11.2 | Cleaning capability become poor at less than 1,000. |
| Comp.Ex.3 | Silica | Amorphous | 0.04 | 0.3 | Cleaning capability become poor at less than 1,000. |
| Comp.Ex.4 | PMMA Resin Particles | Spherical | 0.5 | 0.8 | Cleaning capability become poor at less than 1,000. |

INDUSTRIAL APPLICABILITY

The present invention can provide a cleaning blade that, even upon used with a spherical toner, especially spherical, small-diameter toner, can kept stable cleaning capability over an extended period of time, and enables a cleaning blade having improved cleaning capability to be produced with high reproducibility by using a neutral detergent (a nonionic surfactant). Moreover, the present invention can provide an image forming device equipped with such a cleaning blade.

The cleaning blade of the present invention ensures that even when used with a spherical toner in general and a spherical, small-diameter toner in particular, improved cleaning capability is so achievable that there is no need of modifying toner shape or increasing the amount of an abrasive, resulting in formation of high-quality images excelling in developability and transferability.

What is claimed is:

1. A cleaning blade for removal of an untransferred toner remaining on a surface of an image bearing member, wherein a fine particles are attached to a surface of at least a portion of said cleaning blade to come into contact with said image bearing member in an amount of 1 to 10 mg/cm$^2$.

2. The cleaning blade according to claim 1, wherein the fine particles have an average particle diameter of at least 0.1 μm.

3. The cleaning blade according to claim 1, wherein the fine particles are in an aspheric shape.

4. The cleaning blade according to claim 3, wherein the aspheric fine particles have a sphericity of greater than 1.3 as expressed in terms of a dl/ds ratio where dl is a major axis of a particle and ds is a miner axis of a particle.

5. The cleaning blade according to claim 1, wherein the fine particles are at least one selected from the group consisting of organic fine particles, inorganic fine particles and toner.

6. The cleaning blade according to claim 5, wherein the organic fine particles comprise a synthetic resin selected from polyolefin resins, fluororesins, polyester resins, acrylic resins, aromatic vinyl resins and copolymer resins.

7. The cleaning blade according to claim 6, wherein the organic fine particles are aspheric, pulverized resin fine particles obtained by pulverization of a synthetic resin.

8. The cleaning blade according to claim 7, wherein the synthetic resin is a polyester resin or a styrene-acrylate copolymer resin.

9. The cleaning blade according to claim 5, wherein the fine particles are an aspheric pulverized toner comprising a binder resin and a colorant.

10. The cleaning blade according to claim 5, wherein the inorganic fine particles are inorganic fine particles selected from calcium carbonate, calcium phosphate, silica and molybdenum sulfide.

11. The cleaning blade according to claim 10, wherein the calcium carbonate is a cubic calcium carbonate.

12. The cleaning blade according to claim 1, which is formed of an elastic material.

13. The cleaning blade according to claim 12, wherein the elastic material is a conjugated diene rubber, polyurethane, fluororubber or silicone rubber.

14. The cleaning blade according to claim 1, which has a JIS A hardness of 40 to 90 degrees.

15. The cleaning blade according to claim 1, wherein the untransferred toner is a spherical toner that has a volume average particle diameter of 2 to 10 $\mu$m, a particle diameter distribution of 1.3 or lower as expressed in terms of a dv/dp ratio where dv is a volume average particle diameter and dp is a number average particle diameter, and a sphericity of 1 to 1.3 as expressed in terms of a dl/ds ratio wherein dl is a major axis of a particle and ds is a miner axis of a particle.

16. A process for producing a surface treated cleaning blade for removal of an untransferred toner remaining on a surface of an image bearing member, which comprises applying a nonionic surfactant to a surface of at least a portion of a cleaning blade to come into contact with the image bearing member, and attaching fine particles to the surfactant-applied portion in an amount of 1 to 10 mg/cm$^2$, followed by drying.

17. The production process according to claim 16, wherein the nonionic surfactant is applied to the surface of at least the portion of the cleaning blade to come into contact with the image bearing member, and while the nonionic surfactant is being wetted, the fine particles are brought into contact with the nonionic surfactant to attach to the surfactant-applied portion substantially uniformly, followed by drying at a temperature of 30 to 90° C.

18. An image forming device equipped with a cleaning blade for removal of an untransferred toner remaining on a surface of an image bearing member, wherein said cleaning blade is a cleaning blade which comprises fine particles attached to a surface of at least a portion of the cleaning blade to come into contact with the image bearing member in an amount of 1 to 10 mg/cm$^2$.

19. An image forming method making use of an image forming device equipped with a cleaning blade for removal of an untransferred toner remaining on a surface of an image bearing member, wherein a cleaning blade, which comprises fine particles attached to a surface of at least a portion thereof to come into contact with the image bearing member in an amount of 1 to 10 mg/cm$^2$, is used as said cleaning blade, and a spherical toner is used as a toner.

20. The image forming method according to claim 19, wherein the spherical toner is a spherical toner which is colored in a color tone selected from cyan, yellow, magenta and black.

* * * * *